United States Patent [19]

Maher

[11] 4,286,345

[45] Sep. 1, 1981

[54] QUASI-OCTAGONAL PILLOW CONSTRUCTION AND METHOD

[76] Inventor: Maxine H. Maher, 14219 Minorca Cove, Del Mar, Calif. 92014

[21] Appl. No.: 131,282

[22] Filed: Mar. 18, 1980

[51] Int. Cl.[3] ..... A47G 9/00

[52] U.S. Cl. ..... 5/434; 5/490; 150/1; 229/8

[58] Field of Search ..... 5/490, 491, 431, 432, 5/434, 436, 435, 438, 439, 437, 440; 229/8; 150/1; 5/441, 442, 446, 447; D6/201, 204

[56] References Cited

U.S. PATENT DOCUMENTS 2,008,285 7/1935 Kraus ..... 5/490

*Primary Examiner*—Roy D. Frazier
*Assistant Examiner*—Alexander Grosz
*Attorney, Agent, or Firm*—Brown & Martin

[57] ABSTRACT

Rectangular panel pieces are sewn together by sewing the panel ends to an adjacent panel side so that the side edge of first panel is in alignment with the end of the second panel. Four panel pieces are assembled together in this manner. The free panel edges are then folded over and sewn first to the unattached portion of the adjacent panel edge and the balance further folded and sewn to the adjacent panels free end.

11 Claims, 6 Drawing Figures

QUASI-OCTAGONAL PILLOW CONSTRUCTION AND METHOD

BACKGROUND OF THE INVENTION

A wide variety of pillows are sold for comfort and ornamentation. Pillows are generally made by sewing together panels of the appropriate shape i.e. rectangular panels for a pillow having a rectangular appearance; triangular pieces sewn together to make a triangular pillow, and circular pieces sewn together to make a circular pillow. Various tassels and fringes may be added to the basic shape to vary the appearance. Geometric configurations for pillows, or a plurality of pillows sewn together, that are more complex than the basic round, circular, and rectangular have been made. Such pillows have typically required the use of complex patterns and panel shapes or have required the use of sewing procedures or equipment not normally available to the average person.

It is therefore desirable to have a pillow with a distinctive and useful shape which provides both comfort and ornamentation; while at the same time being assembled from geometrically simple and identical pattern pieces and requiring no more than basic sewing skills and equipment. Such a pillow is particularly desirable where it produces an octagonal shape with inclined edges to provide a visually attractive orientation to the fringes and tassels that may be attached.

SUMMARY OF THE INVENTION

In an exemplary embodiment rectangular fabric panel, pieces are assembled to produce a quasi-octagonal pillow. However, any elongated parallelogram panel shape (with straight or curved edges) can be utilized. However, the rectangular shape enhances the easy assembly of the pillow because the various fabric panels may be joined together with straight stitching. It will be apparent that the rectangular panel pieces may be assembled from two or more fabric segments to produce additional seam lines if desired. Further, rectangular panels with sides twice the length of the ends are particularly desirable because of the desirable quasi-octagonal shape of the finished product. Excluding the seam allowance the basic panels pieces are arranged with their ends abutting the sides of the adjacent panel piece. The panel pieces are arranged so that the edge of a side is aligned with the edges of an end of the adjacent panel piece. The resultant layout gives a cross-like appearance when laid on a flat surface. The panel pieces are stitched together along their contacting edges. Each panel piece then has a free outer side, a partially secured inner side and a free outer end. The free side of each panel piece beginning at the attached end, is sewn first along the partially secured side of the adjacent panel piece, and then balance is sewn along the free outer end of the same adjacent panel piece. Each free outer side edge is secured to its adjacent panel piece in the same manner. The process results in an enclosed volume defined by the rectangular panels sewn together, so that every side has the end edge and side edge of an adjacent panel joined along it.

For stuffing, a zipper may be substituted for part of one of the sewn seams or the stuffing may be introduced into the semi-enclosed volume before the last seam is attached.

The resulting pillow is advantageous in that it requires relatively low sewing skills and can be rapidly assembled from easily cut panel pieces. The panel pieces may desirably be rectangular resulting in an even simpler assembly process. The pillow construction lends itself to a readily understood step-by-step instructions and may be folded during assembly such that the seam stitching is easily hidden. The finished pillow is durable due to the strong stitched seams and has an enclosed volume that is easily stuffed to a sufficient depth to provide comfort for the ultimate user. As assembled there are no sharp edges to cause discomfort when they contact a part of a users body. A further advantage of the pillow is that the seams are natural attachment points for ornamentation and are, over a portion of their length, at an angle to the main body of the pillow. Accordingly ornamentation attached along these portions of the seams has a distinctive and attractive appearance. Other advantages of the invention will become more apparent from a reading of the following detailed description together with the drawing in which like reference numerals refer to like parts throughout, and in which:

DETAILED DESCRIPTION OF THE DRAWINGS

Figure 2:
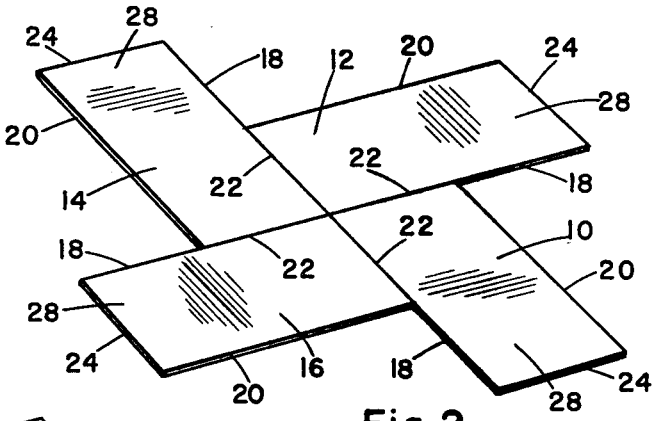
FIG. 2 is a perspective view showing the initial joining of the four rectangular panel pieces.

Referring now to the drawings, there is illustrated, in FIG. 2, the four panel pieces 10, 12, 14 and 16. Each panel piece has side edges 18 and 20, and end edges 22 and 24. For clarity in the illustration the edges are shown without any seam allowance. However, it will be understood that a seam allowance will normally be made by folding over approximately 1.5 cm of each attached edge. The end 22 of pattern piece 10 is arranged along the side 18 of the adjacent panel piece, and the same arrangement made for panel piece 12 with respect to 14, 14 with respect to 16 and 16 with panel piece 10. Since the sides are approximately twice the length of the ends there remains an unattached edge portion 28 followed by an unattached end 24 and unattached edge 20 on each pattern piece. During the initial assembly as described above it is most practical to work with the pattern pieces by placing them on a flat surface of sufficient size so that all of the pattern pieces may be maintained in the planar orientation illustrated. Also during the initial assembly stage it is most practical to provide for a zippered opening. The zippered opening may be provided along the line defined by either of the two sets of ends 22 that are in alignment.

Figure 3:
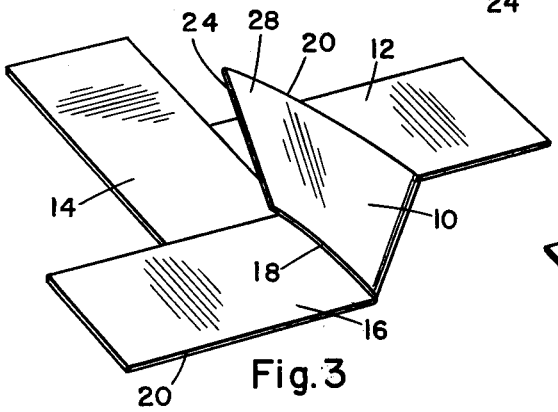
FIG. 3 illustrates the folding of the first panel.
Figure 4:
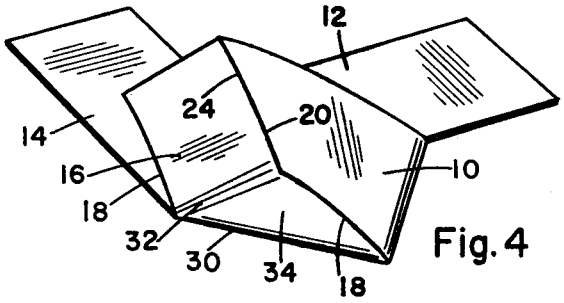
FIG. 4 illustrates the folding and joining of a second panel.

The remaining assembly may be accomplished in either direction but for purposes of illustration panel piece 10 is shown in FIGS. 3 and 4 being assembled to the panel piece 16. The panel piece 10 is first stitched along its edge 18 to the free side 20 of panel piece 16. Then the free end 24 of panel piece 10 is stitched along the same free side 20 on panel piece 16. Note that this causes a flexing of the panel piece 16 along bend lines 30 and 32 forming a generally triangularly shaped surface 34. The underside of the pillow contains a corresponding generally triangular shaped planar area (not shown).

Figure 5:
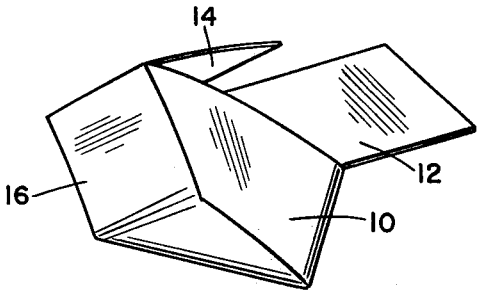
FIG. 5 illustrates the folding and joining of the third panel.

The joining of the various panel edges continues in the manner described above for the remaining panel pieces as is illustrated for the panel piece 14 in FIG. 5.

Figure 6:
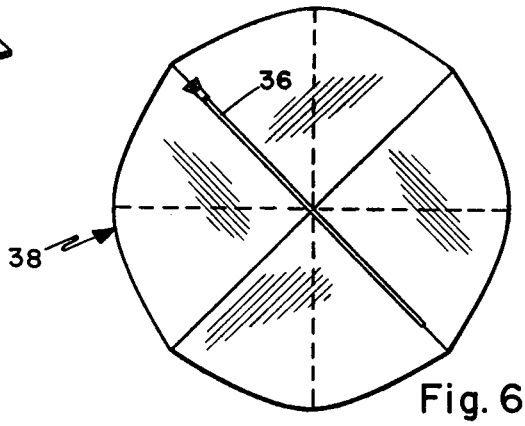
FIG. 6 is a top plan view of the complete pillow showing the seam lines.

Referring to the top plan view of the pillow 38 in FIG. 6 the quasi-octagonal shape of the pillow is apparent. As illustrated, the bending and sewing of the panel pieces results in the final edges being joined at a 45° angle to the initial edges. FIG. 6 also shows the location for a zipper 36. Zipper 36 is opened and the appropriate amount of stuffing, added to produce the amount of loft desired.

Figure 1:
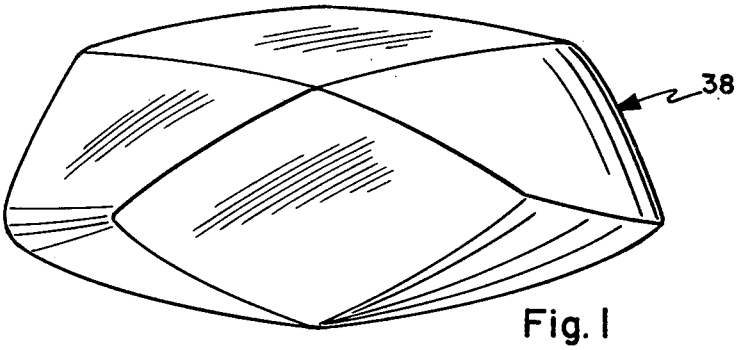
FIG. 1 is a perspective view of a completed pillow.

FIG. 1 is representative of the finished appearance of the pillow 38 with a typical amount of stuffing inserted. As will be apparent the finished pillow provides a many faceted appearance with seams at many different angles one to another. Ornamentation attached along these seams does not interfere with the shape of the pillow because it follows the line of the stitching nor does it reduce the softness of the pillow for the same reason. Since the stitching attached along the edges is arranged at an angle to the main body of the pillow, unique and desirable ornamental effects can be obtained.

Having described my invention I now claim:

1. A pillow construction comprising:

four parallelogram shaped panel pieces having edges longer than their ends, the first end of each panel being joined along a first side of an adjacent panel with the edge of a first side of such panel being in alignment with the edge of a first end of an adjacent panel, each panel being folded and the second side of each panel being joined to the first side and the second end of an adjacent panel.

2. The pillow construction according to claim 1 wherein:

said panel pieces are rectangular in shape.

3. The pillow according to claim 2, wherein:

the sides of the rectangle are twice the length of the ends.

4. The pillow according to claim 1 wherein:

the pillow shape is maintained by stuffing inserted into the enclosed volume of the pillow prior to stitching of the final panel pieces.

5. The pillow according to claim 1 further including:

a zipper being provided along one of the seams formed in joining the panel pieces, the pillow shape is maintained by stuffing inserted into said pillow through the closable opening formed by said zipper opening.

6. The pillow according to claim 5 wherein:

said zipper is arranged along a seam incorporating an edge of two of said panels.

7. The pillow according to claim 1 wherein:

said edges are folded back a predetermined distance prior to stitching to provide a seam allowance.

8. A method of manufacturing a pillow incorporating four main panel pieces comprising the steps of:

stitching together first and second of the panels adjacent an end of the first panel and a side of a second panel to form a first abutting section, stitching together third and fourth panels adjacent to a side of the third panel and an end of the fourth panel to form a second abutting section, joining first and second abutting sections adjacent to the edge of each section that incorporates both panels, joining the free side of each panel to the free portion to the adjacent panel side and to the end of that adjacent panel.

9. The method of claim 8 further including the step of:

prior to joining the panel edges folding back a seam allowance.

10. A method of claim 8 further characterized by:

sewing a zipper along the seam of two ends in alignment, inserting stuffing through the zippered opening.

11. The method of claim 8 further characterized by inserting stuffing material prior to the sewing of the last panel edges.

* * * * *